US005719777A

United States Patent [19]

Kotaki

[11] Patent Number: 5,719,777

[45] Date of Patent: Feb. 17, 1998

[54] KNIT DESIGN METHOD AND KNIT DESIGN APPARATUS

[75] Inventor: Kenji Kotaki, Kishiwada, Japan

[73] Assignee: Shima Seiki Manufacturing, Ltd., Wakayama, Japan

[21] Appl. No.: 730,394

[22] Filed: Oct. 15, 1996

[30] Foreign Application Priority Data

Oct. 16, 1995 [JP] Japan ..... 7-293381

[51] Int. Cl.[6] ..... G06F 19/00

[52] U.S. Cl. ..... 364/470.02; 66/75.2; 364/470.12

[58] Field of Search ..... 364/470.02, 470.03, 364/470.12, 191–193; 66/75.2, 232, 238; 345/441, 442, 443

[56] References Cited

U.S. PATENT DOCUMENTS 4,608,642 8/1986 Shima ..... 364/470.12
5,388,050 2/1995 Inoue ..... 66/75.2 X
5,557,527 9/1996 Kotaki et al. ..... 364/470.02
5,646,861 7/1997 Kotaki ..... 364/470.06

OTHER PUBLICATIONS

International Application PCT/EP93/03219 filed Nov. 16, 1993.

*Primary Examiner*—Joseph Ruggiero
*Attorney, Agent, or Firm*—Nikaido, Marmelstein, Murray & Oram LLP

[57] ABSTRACT

Design data of a knitted product are divided into plural layers, layer numbers are given to the layers, and the layers are stored. The default value of a layer number is the number of the latest layer plus 1, and the layer numbers can be modified. It is made possible to unite or group plural layers into a group, and a layer number is given to the group. It is also made possible to cancel grouping.

13 Claims, 6 Drawing Sheets

KNIT DESIGN METHOD AND KNIT DESIGN APPARATUS

FIELD OF THE INVENTION

The present invention relates to designing of knitted products and an apparatus therefor, and in particular, is intended to provide a new design environment.

PRIOR ART

The basic trend regarding knitted products is production of multiple products in small quantities. Hence it is necessary to produce a larger number of more advanced designs in a shorter time. The knit design apparatus is a CAD apparatus for supporting designing of knitted products, and the knit design method is a design method using this apparatus.

The present applicant proposed, in Japanese Provisional Patent Hei 7-119,004 (EP640,707A1), to divide the design of a knitted product into three planes of structural pattern, intarsia and jacquard to store. As a result, the respective designs of structural pattern, intarsia and jacquard become independent from each other, and each plane can be designed independently from each other. However, modification of a design in one plane is made by overwriting. Thus when design data are modified, the design data that were originally present there or the data of the substrate will be lost. In a design wherein structural patterns are intricate, if a part of the structural pattern is moved, the design data of the original position from which the part has been moved will be lost. The treatment after a move is simple if it is sufficient to replenish simple data such as faces of plain knit or backs of plain knit in the position of which data have been lost. However, if the structural patterns are intricate, it will become necessary to input another structural pattern in the blank that has been generated by the move of design data. This work is tiresome. Similarly, when a design is deleted, there will be no design data in the deleted part. Then it will become necessary to input appropriate design data into this part.

These problems are generated whenever a design element is moved due to grading or a design is modified. The problems are not limited to the structural pattern. Similar problems will occur for designs of jacquard, intarsia, etc. With the production of multiple products in small quantities, the production number of knitted products per one design has been decreased, and the number of designs has been increased. It, therefore, is necessary to make design modification such as grading easier and design a knitted product in a shorter time.

BRIEF DESCRIPTION OF THE INVENTION

The primary task of the present invention is to make designing knitted products easier, and in particular to make easier modification and grading of designs.

The secondary tasks of the present invention are as follows:

1) To make priority levels of layers modifiable.
2) To make it possible to treat plural layers as one group.
3) To reduce the memory capacity required to store a knit design.
4) To keep the compatibility with the conventional knit design apparatus and to make mixture of design such as jacquard easier.
5) To make it possible to automatically give an appropriate priority.

6) To make it possible to easily determine the priority sequence of various layers.

The present invention is a method of designing a knitted fabric, while inputting the design data of the knitted fabric and displaying the inputted design data on a monitor, comprising:

giving, when a design element of the knitted fabric is inputted by a user, a priority level to the design data of the element and storing the data as a data layer;

determining, when plural layers are overlapped on the same position in the design of the knitted fabric, the priority levels of the layers according to a priority sequence, and converting the design data of the knitted fabric into knitting data according to the determined priority levels.

Preferably, a process for modifying the priority sequence according to a request of the user is provided. Preferably, a process for grouping plural layers and giving a priority level is provided. Furthermore, preferably, a process for disintegrating grouped layers into individual layers is provided. Preferably, data of at least some layers are inputted and stored as non-raster data. Preferably, the design data are stored as both raster data and non-raster data, and input as raster data by the user is accepted, a priority level is given to the data and the input is stored as faster data.

The present invention is a knit design apparatus having an input means for inputting the design data of a knitted fabric and a monitor for displaying the inputted design data, comprising:

a means for giving priority levels to the design data of the respective design elements of the design of the knitted fabric and storing the design data as data layers;

a retrieval means for determining the priority levels of layers according to a priority sequence when plural layers are overlapped on the same position of the design of the knitted fabric; and a compiler for converting the design data of a relevant layer into knitting data according to the determined priority levels.

Preferably, a means is provided for accepting an input of priority level by the user and for giving, when the user does not input a priority level, a priority level, being higher at least than that of some of already inputted layers, to the newly inputted layer. Further, preferably, a means for storing a menu program is provided, a menu is displayed on at least a part of the monitor, said menu is provided with a sub-menu for modifying priority, the user is asked to designate the priority levels of the new layers, and the priority sequence of layers is modified according to the designated priority levels and stored. Preferably, said retrieval means is configured to retrieve the data of the respective layers in the order from the layer of the lowest priority to the layer of the highest priority, and to overwrite the design data of a layer of higher priority on the design data of a layer of lower priority. Preferably, said menu is provided with sub-menus for grouping plural layers and cancelling of grouping, and plural layers designated by the user is formed into a group by grouping and a priority level is given to the group, and a group is separated into individual layers by the cancellation of grouping. Preferably, said memory is provided with a memory for storing design data in non-raster format. Particularly preferably, said memory is composed of a memory for said non-raster format and a memory for storing design data of at least some of the layers in raster format.

According to the present invention, the design of a knitted fabric inputted by a user is divided into layers by element, priority levels are given to the respective design data of the layers, then the design data of the layers are stored. The priority levels define the priority sequence for the layers, and when plural layers are overlapped in the same position, the priority levels determine which layer is given the priority according to the priority sequence. Then the design data are converted into knitting data according to the determined priority sequence.

According to the present invention, design elements comprise, for example, points, lines and planes of stitches. In the present invention, the design element is a concept that is different from the kind of stitch and represents a unit or collection of design such as above-mentioned points, lines and planes.

According to the present invention, the design of a knitted fabric is divided into plural layers forming a multiple-layer structure, and only the layers of the highest priority are reflected in the final design. The design of a knitted fabric is divided into layers, and deletion, move, copy, etc. of any layer have no effects on other layers. Hence the user can design a knitted fabric by layer; thus a design can be made easily. When a layer is moved due to grading, etc. or design modification, the layer directly beneath the moved layer will appear; the move in the design will not pose a problem of creating a blank area without any data. Thus design modification such as grading can be made easily.

The priority sequence may be designated by the user. If the user does not designate the priority sequence, the design apparatus will allocate default values to the respective layers. In this case, preferably, the newer is the inputted layer, the higher is the priority level allocated. With this arrangement, the user or operator of the knit design apparatus can start with a simple layer and proceed gradually to more complex layers. The priority levels of the layers due to the default values are set in such a way that the simpler is the layer, the lower is the priority level, in other words, the more complex is the layer, the higher is the priority level. This arrangement follows the natural behavior of the designers that they start a design with a relatively simple and large portion and gradually proceeds the design to smaller and more complex portions.

Now, when it is made possible to modify the priority sequence, the degree of freedom of design will be increased further. For example, after a layer is made, if the design of the layer is found to be not desirable, the priority sequence may be modified. The modification of the priority sequence will change the priority levels of the layers; the user can freely select which layer's design is to be reflected in the final design.

There may be cases where it is desirable to unify plural layers into a group and treat the group as a new single layer. For instance, in the case of a cable pattern of 3×3, three stitches on the left-hand side and three stitches on the righthand side are one integral pattern from the viewpoint of knitting. These two sets of stitches may be designed, from the beginning, as a single layer, or they may be designed as two separate layers at first, then the two layers may be grouped afterwards. Regarding a new priority level to be given to the group, for example, if the original layers are a layer A and a layer B, the higher priority level of the layers A and B may be given to the group, or a completely different priority level may be given to the group. Unification of layers is not limited to the above-mentioned case. Even when no grouping is required from the viewpoint of knitting, grouping may be used for the convenience in design, thus using a group as a unit for move, copy, etc. In this way, it is made possible to unify plural layers, being combined in design, into a single layer and to move, copy or modify by group.

Preferably, it is made possible to disintegrate any grouped layers into the original individual layers. This is effective in taking out a part of grouped layers to modify, delete or move it. It is also desirable to make the priority level of any group modifiable. The modification of the priority level of any group can be made in the same manner as the modification of the normal priority levels.

With grouping of plural layers, modification of the priority level of any group and cancellation of grouping, plural layers can be handled as a single layer. A unity of grouped layers is just like a normal single layer, can be moved, modified and copied by group, and can be separated into original layers by cancellation of the grouping.

The data of a single design are divided into plural layers through layering of design data, modification of priorities, grouping, modification of group number, and cancellation of grouping. Which layer to be given priority can be modified by modifying the priority sequence. Plural layers can be virtually treated as a single layer in practice and, conversely, grouped layers can be separated into the original layers. As a result of these operations, the design data of a knitted product are made into plural layers laid up one after another, which layer's design data to be reflected in the final design can be modified, and the design data can be handled by layer and group.

The design data of each layer may be stored in raster format, in other words, a certain number of pixels are allocated to each stitch and data may be actually stored for every pixel. Preferably, the design data of at least some layers are stored in non-raster format. Storage in non-raster format means that when a layer is a point, the position of the point is stored, when a layer is a line, the position of the line is stored, and when a layer is a plane, its outline is stored. In other words, a non-raster format is a format that designates the form of a pattern with the its outline, etc. The data in a non-raster format are often called vector data in the field of image processing. In this specification they may be referred to as vector data. When the design data are converted from raster data into vector data, the memory capacity needed for the design apparatus will be reduced significantly.

Preferably, a memory for raster format is supplementally provided in the design apparatus to enable design data input in raster format. Then appropriate priority levels are given to the design data in raster format. With these arrangements, the compatibility with the conventional design apparatus is maintained. In the conventional design apparatus, the design data of a knitted fabric are inputted in raster format. Hence, with the provision of a memory for raster format, a design similar to a conventional one can be made. When a design superior in priority to a design in a layer in raster format is to be added, it is sufficient to make a layer of which priority is higher than the layer of input in raster format. Provision of a memory for raster format is also effective in designing a pattern such as jacquard. Jacquard pattern is not suited to inputting in vector format. Jacquard pattern may be inputted in raster format, then an appropriate priority level may be given to it.

When the design data are converted into knitting data, the priority sequence of the layers will be determined according to the priority levels given to the respective layers. In this case, the simplest method is to start retrieval with the layer of the lowest priority, overwrite a layer of higher priority on a layer of lower priority, and convert, when retrieval of all layers is completed, the design data into knitting data. As a result, the data of layers of lower priority are destroyed by overwriting of the layers of higher priority, and only the design data of the layers of the highest priority at the respective positions can be converted into knitting data.

BRIEF DESCRIPTIONS OF THE DRAWINGS

EMBODIMENTS

Figure 1:
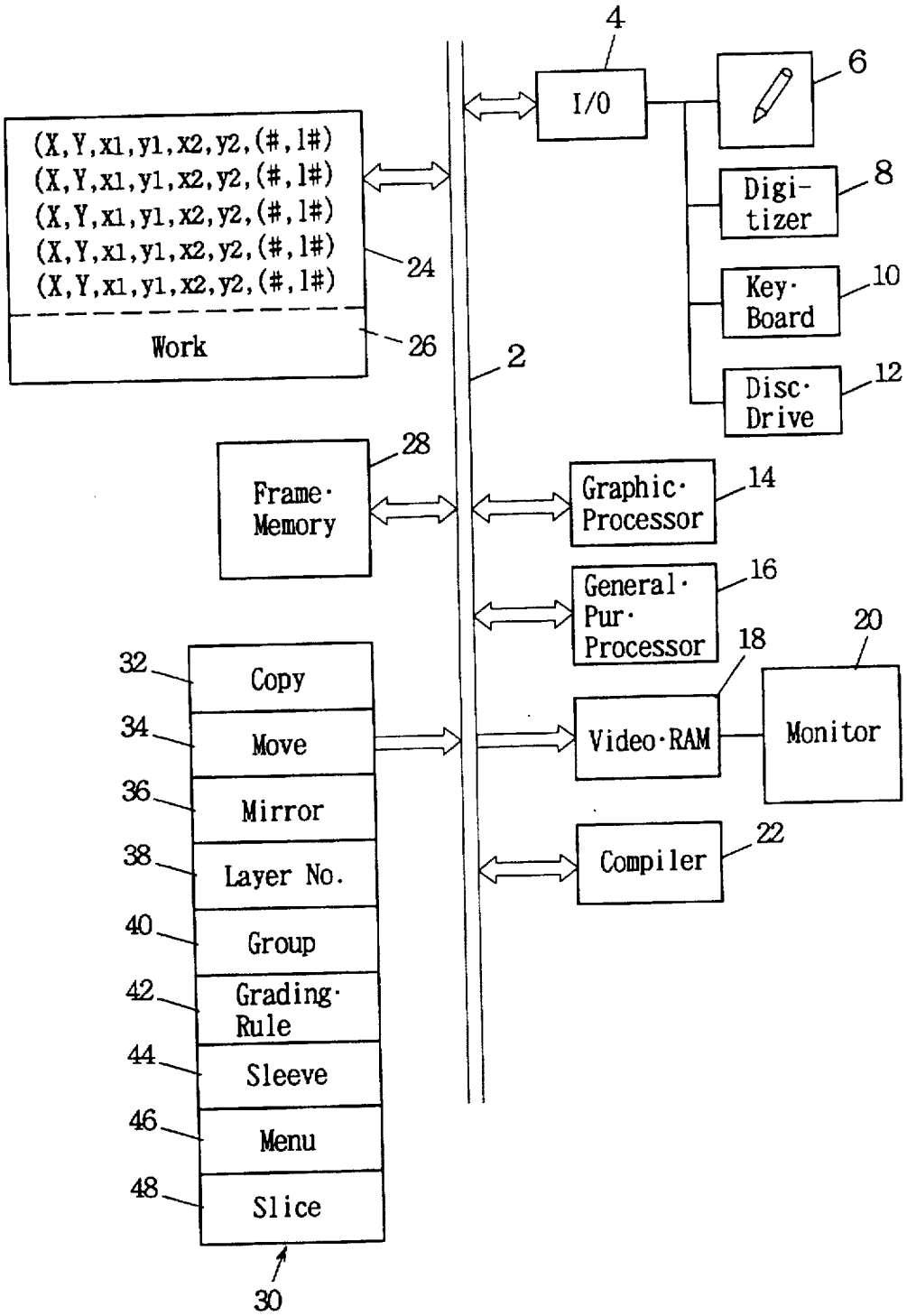
FIG. 1 is a block diagram showing the hardware configuration of a knit design apparatus of an embodiment.

FIG. 1 through FIG. 6 show embodiments. FIG. 1 shows the hardware configuration of a knit design apparatus of an embodiment. 2 denotes a bus. Distinction between an image bus and a bus of other instructions, etc. is not made. The bus is indicated as a single bus 2. 4 is an I/O device to which, for example, a stylus 6, a digitizer 8 for inputting pattern data, a keyboard 10 for numerical input and command input, and a disc-driver 12 for floppy disc or magneto-optic disc are connected.

14 is a graphic processor, 16 is a general use processor, 18 is a video RAM, and 20 is a monitor. 22 is a compiler for converting completed design data into knitting data.

24 is a memory that stores the design data of respective layers in the form of, for example, vector data. Of the vector data shown in the diagram, capital letters X and Y represent the fiducial point of the layer, for example, the offset of the starting point of a line, plane, etc. Here the vector data show a rectangular area, indicating the coordinates (x1, y1) and (x2, y2) of two diagonal points. In the present specification, of the two sets of coordinates of two diagonal points of the rectangular area, the former set of coordinates (x1, y1) represent the starting point. The role of the two sets of coordinates (x1, y1) and (x2, y2) is to designate an area, and the designating method depends on the kind of area. For example, when a layer comprises a single point, it is sufficient to designate the coordinates of the point. In case of a circle, it is sufficient to designate the coordinates of the center and the radius. In case of a straight line, it is sufficient to designate a starting point and a terminal point. In case of a curve, it is sufficient to designate the starting point coordinates, the terminal point coordinates, coordinates of several intermediate points and the kind of curve. An offset and the outline of a pattern are designated for each layer.

At least a color number is designated for each layer. The color number corresponds to the kind of stitch, has a word length of about one byte, and can be displayed as color data. It should be noted that there is no need of interpreting the stored data as color data. A layer number is given to each layer as data for designating the priority level of the layer relative to other layers. Instead of directly designating the priority levels of the layers with layer numbers, a look-up table between the layer numbers and the priority sequence may be provided. The layer numbers are designated by the user through the menu, however, if no designation is made by the user, a layer number that is greater by one than the layer number of a layer that was inputted immediately before the layer to which no designation was made will be given as the default value. In the embodiment, the greater is the layer number, the higher is the priority level. In the memory 24 are stored the offset, outline data, color number and layer number for each layer. 26 is a work area provided in the memory 24.

28 is a frame memory and is provided to maintain the compatibility with the conventional design apparatus. For example, if the frame memory 28 as a whole stores one layer, the layer number and offset of the layer are stored, for example, in the memory 24. However, the layer number and offset may be stored in a part of the frame memory 28. One frame memory 28 may be divided for use by plural layers, and in that case, the offset and layer number of each layer are stored in the memory 24.

30 is a ROM and stores the programs of various processes by the processors 14 and 16 and tables of constants, etc. 32 is a copy unit that stores copying programs. 34 is a move unit storing programs of move processing. 36 is a mirror inversion unit storing mirror inversion processing programs. 38 is a layer number control storing programs for generating layer numbers from default values and modifying layer numbers. 40 is a group formation unit storing programs for unifying plural layers into a single group. The group formation unit 40 is made to store a program for cancelling grouping. The grouped layers do not differ from other layers from the viewpoint of layer management, and giving a layer number to a group and modifying a layer number are treated by programs stored in the layer number control 38.

42 is a grading rule table storing conditions of data modification attendant on grading. Modifications of outline data attendant on grading are of several kinds, and these rules are stored in the grading rule table 42. The modification of the outline data is attended by rearrangement of various elements of the knitted fabric, and there are plural rules for this rearrangement. These rules are also stored in the rule table 42. 44 is a sleeve connection memory and is used for integral knit. In case of integral knit, the sleeve form and the body form at the armhole are determined relative to the outline data so that the sleeves and the body can be connected. The sleeve connection memory stores the programs for this purpose.

Figure 3:
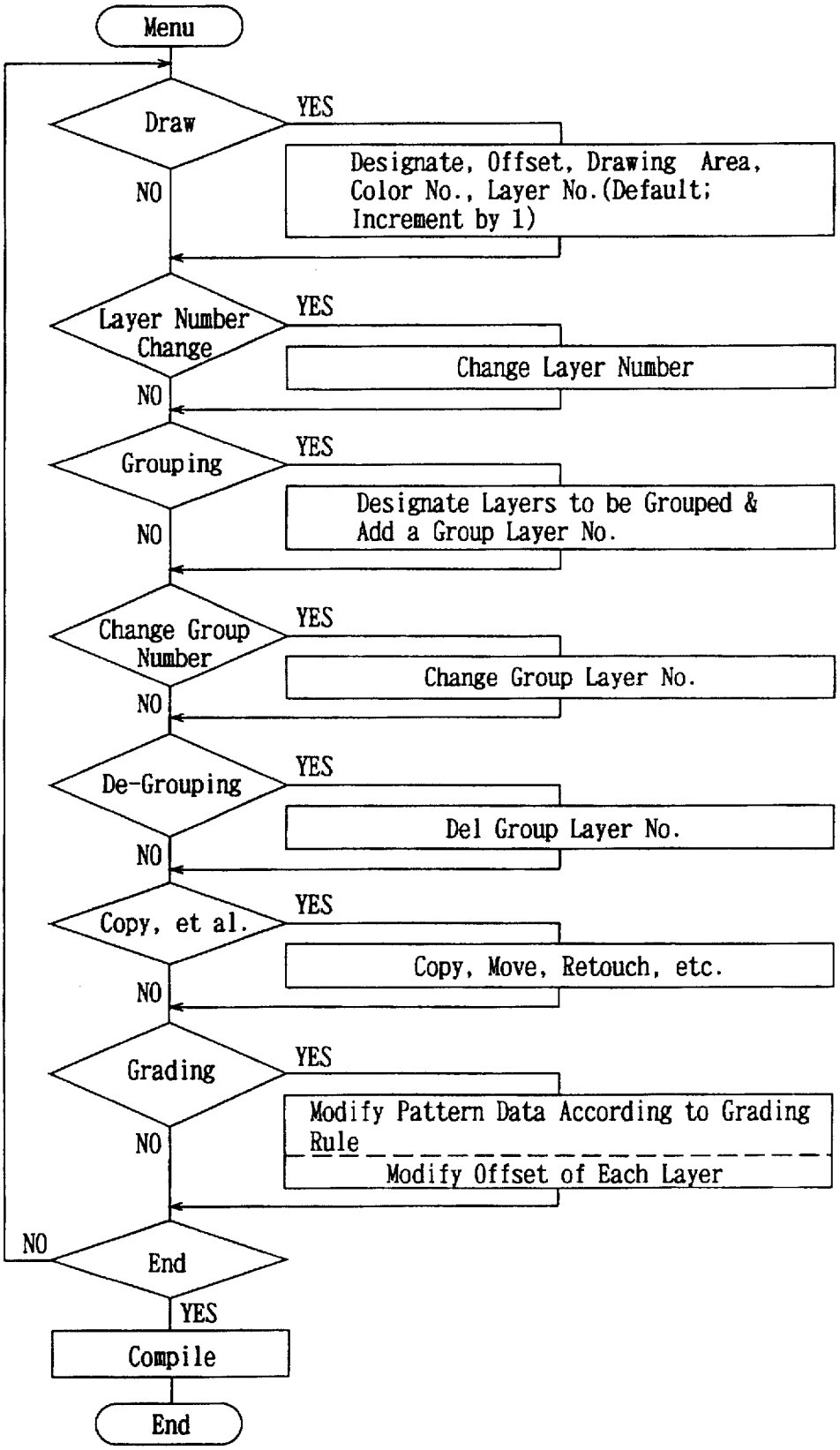
FIG. 3 is a flowchart showing a knit design method of an embodiment.

46 is a menu program memory and stores programs for menu processing. The contents of the menu processing are shown in FIG. 3. Main items include designation of layer number, change of layer number, grouping and change of group layer number, de-grouping or cancellation of grouping, graphic processing such as layer drawing, copy, move and retouch, etc., grading and conversion to knitting data.

48 is a slice unit that slices the design data of raster format into plural layers. Existing design data having no layer numbers are inputted through the disc-driver 12 and stored in the frame memory 28. The slice unit 48 slices the data in the frame memory 28, for example, for each color number, identifies a unified area of the same color number as a single layer, generates an offset and outline data, designate a temporary layer number and store the layer in the memory 24. Next, the layer number is changed by the program of the layer number control 38. In this way, the existing design data in raster format can be converted into design data in the format of the embodiment.

Figure 2:
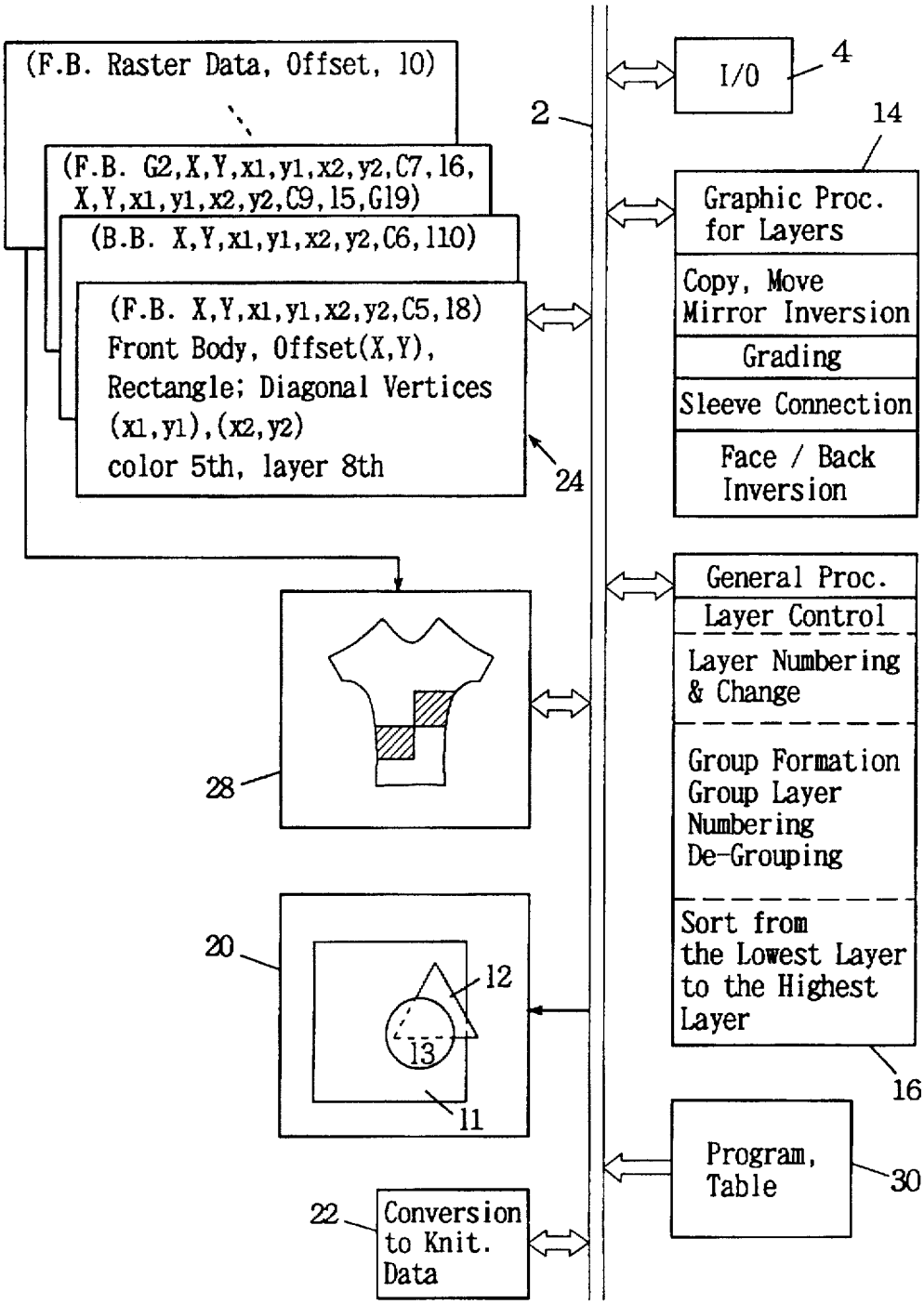
FIG. 2 is a block diagram showing the operations of the knit design apparatus of the embodiment.

In FIG. 2, the design apparatus of the embodiment is shown again according to its operations. The graphic processor 14 executes graphic processing for respective layers, copy, move and mirror inversion of layers, grading, etc. The graphic processor 14 also determines the armhole forms at the joints between the body and the sleeves to make the sleeves connectable to the body. Moreover, in case of integral knit, for example, the graphic processor 14 makes face stitch/back stitch inversion. The general use processor 16 executes general processing, for example, layer control including designation of layer number and change of layer number, and group control such as group formation, group layer numbering and de-grouping. The general use processor 16 also executes sorting from the lowest layer to the highest layer. To support these operations, programs, look-up tables, etc. are provided in the ROM 30.

In the embodiment, integral knit of, for example, a sweater is made. The design of the knitted fabric is roughly divided into four parts, the front body, back body, right sleeve and left sleeve. Descriptors are given to the respective parts; a descriptor F. B. to the front body, a descriptor B. B. to the back body, a descriptor R. S. to the right sleeve, and a descriptor L. S. to the left sleeve. These descriptors represent basic elements of the knitted fabric, such as the front body and the back body. Even if the layer number is identical, data having different descriptor such as F. B. and B. B. are processed as completely different data. When a pocket, etc. is provided, the data for the pocket are stored with a descriptor for pocket such as P.

In the memory 24 is shown a layer of front body, offset (X, Y), a rectangle with diagonal vertices (x1, y1), (x2, y2). The color number of this layer is 5 and the layer number is, for example, 8. Data of other layers are also stored in a similar format. In addition to them, the raster format may be used. An example of the raster data of the front body, being stored with a layer number 0, is shown in FIG. 2. The relevant raster data are in the frame memory 28. The relationships of these layers can be seen on, for example, a monitor 20. For example, when three layers 11, 12 and 13 are overlapped as shown in the diagram, priority in interpreting and displaying is given to layers having higher layer numbers. Each layer, one at a time, is displayed on the monitor 20, or only layers on the top surface when the layers are overlapped are displayed on the monitor 20. The compiler 22 converts only the data of layers appearing on the top surface into knitting data.

Figure 6:
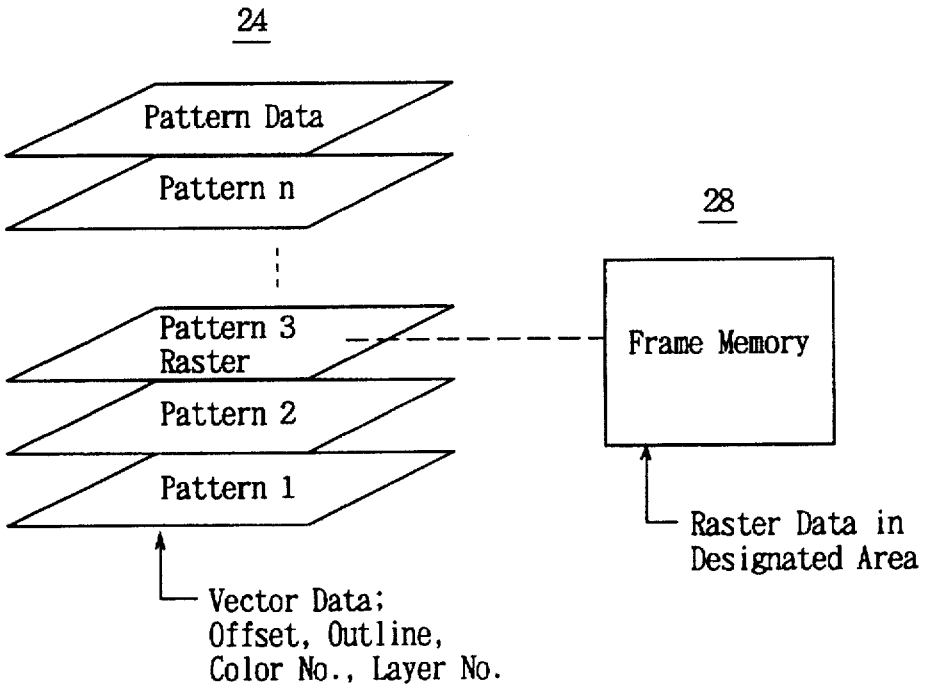
FIG. 6 is a diagram showing the structure of the design data in the embodiment.

The relationship of the respective layers in the embodiment are as shown, for example, in FIG. 6. The layers from the pattern 1 through the pattern n are hierarchized according to the layer numbers and layered. The layer numbers can be changed at any time, and plural layers can be unified into a layer. In the case of FIG. 6, the layer of the pattern 3 is raster data, and the offset of the pattern 3, the layer number 3 and a descriptor indicating that this layer is raster data are stored in the memory 24. The design data of the pattern 3 are stored in the frame memory 28. Either plural layers or one layer may be stored in the frame memory 28. Although not being meant any special definition but the pattern data, the outline data of the fabric, inputted through the stylus 6, digitizer 8, etc. are given the highest priority among all the layers. Although these pattern data are normally inputted first, a layer number of the highest priority is to be designated to the pattern data.

One of the applications of the frame memory 28 is to allow a user, who does not like inputting design data by layer and prefers a design environment of raster format free of the layer concept just like the conventional cases, to make a design in raster format. In this case, the layer number 0 being a temporary layer number is designated to the data in the frame memory 28. This is the layer number of the lowest priority. Another application of the frame memory 28 is to facilitate designing of jacquard, etc. In this case, for example, an area of circle, rectangle, etc. having a jacquard pattern is designated as the area of a layer, and a descriptor of raster data is added to the data. Then the data are stored in the memory 24. On the other hand, the frame memory 28 is divided into an appropriate number of parts. Each of these parts receives an input of jacquard data of a layer.

Figure 4:
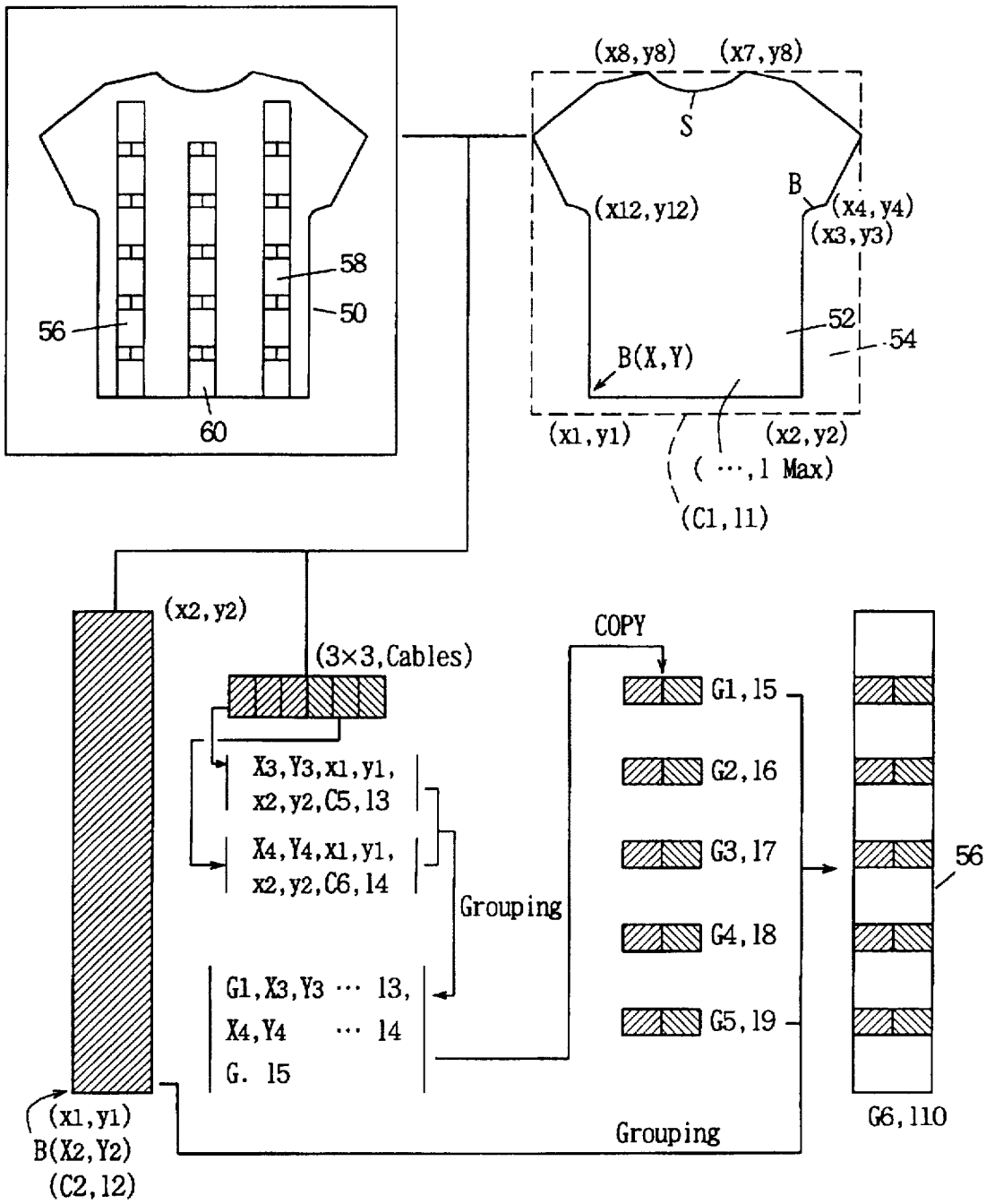
FIG. 4 is a process diagram showing the design process of a front body in the embodiment.
Figure 5:
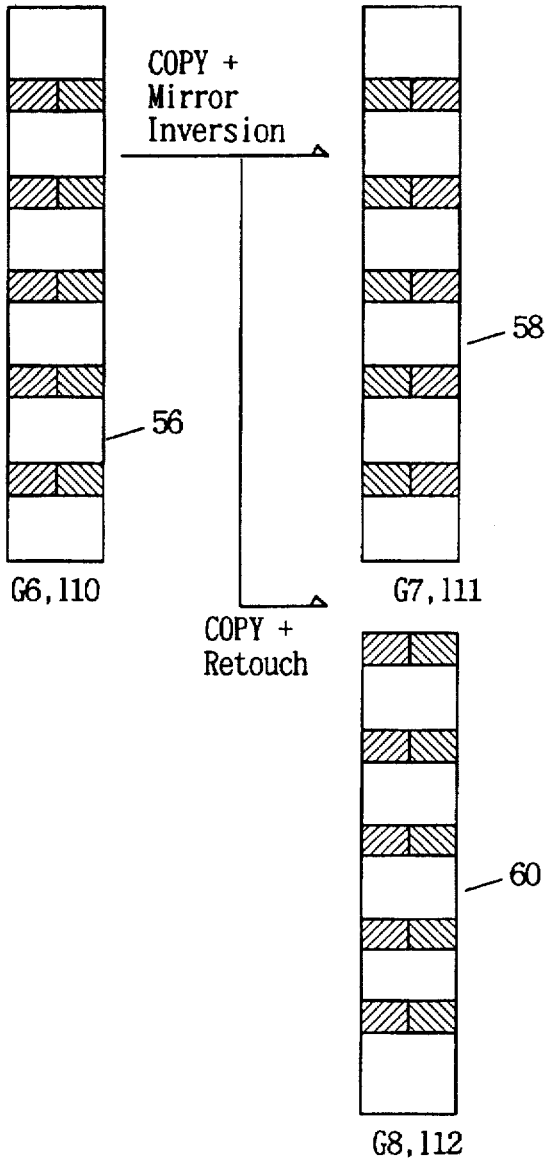
FIG. 5 is a process diagram showing the design process of the front body in the embodiment.

The design processes in the embodiment are shown in FIG. 3 through FIG. 5. Design data 50 of FIG. 4 are to be designed. The first work is to input the pattern data by means of a digitizer 8, etc., and illustration of this process is omitted. The layer of the pattern data is 52. This layer has the layer number of the highest priority, and the contents of the data are the shaping data such as the pattern and attendant increases and decreases, and there are no data for the inner area of the pattern. Next, on the basis of the outline data, drawing is started. For example, a range wider than the outline data is designated, and for example, a color number 1 corresponding to the face of plain stitch is designated to generate the lowest priority layer 54. These data are stored in the form of vector data; for example, when the starting point has coordinates (x1, y1), the offset of the starting point has coordinates (X, Y). Next, regarding the pattern data, etc., as the outline is a closed curve, the coordinates of its vertices are inputted in sequence in such a way that the terminal point is the starting point. For the curve portions of the outline, approximation conditions such as spline approximation and beget approximation are added as descriptors so that the curve portions can be interpolated from the kind of descriptor.

When the design of the lowest layer is completed, the design of, for example, the layer 56 will be started. To do so, for the entirety of the layer 56, an offset (X2, Y2) and coordinates of two diagonal vertices (x1, y1), (x2, y2) are designated. These coordinates can be easily designated by designating with, for example, the stylus desired points on the screen. Then a layer number 2 is designated for this area, and a color number 2 corresponding to the back of plain stitch is designated. Suppose that the layer 56 has, for example, many cable patterns of 3 stitches ×3 stitches. Three stitches on the left of the cable pattern are drawn as one layer and three stitches on the right of the cable pattern are drawn as another layer. When the starting point of each layer is designated, the offset will be generated, and when two diagonal vertices are designated, their coordinates will be inputted. When a color is designated, the data of the color will be filled inside the designated outline. Lastly, the user designates the layer number. If the user does not designate the layer number, the apparatus will designate a layer number that is the latest layer number generated plus 1. In the embodiment, we assume the user has not designated layer number up to this point. According to the default values, a layer number 1 is designated to the lowest layer, and a layer number 4 is designated to the layer lastly inputted.

Two layers of the 3×3 cable pattern should be treated in a unified manner, hence they are designated to be grouped. To do so, it is sufficient to select grouping from the menu displayed in the bottom, etc. of the monitor 20. As the 3×3 cable pattern is the first group, a group number G1 is given to it by the grouping, and a layer number 5 is given, for example, by a default, to the entire group. The vector data of the original two layers are included intactly in the vector data of the group, and the vector data of the original two layers are deleted from, for example, the memory 24. The layer numbers of the original individual layers are left in the grouped layers. This is to define the priority sequence in the group. In the case of FIG. 4, the grouped 3×3 cable pattern is copied, for example, four times. To make a copy, copy is selected from the menu, and a point of the group G1 is designated by the stylus 6, then coordinates of a copy destination are designated by the stylus 6. By copying, new groups G2 through G5 are generated, and layer numbers 16 through 19 are generated for these groups. The contents of vector data of each of the groups G2 through G5 is similar to those of the vector data of G1. The offset is modified, and attendant to it, the coordinates of the diagonal two vertices are changed by the offset, and at the same time, the layer number and the group number are changed. The groups G1 through G5 and the layer in the left bottom corner of FIG. 4 are grouped to generate a layer 56. Here, the layer in the left bottom corner of FIG. 4 and the grouped layers G1 through G5 are overlapped with each other, and the priority levels of these overlapping portions are determined by the comparison between the layer number 12 given to the layer in the left bottom corner and the layer numbers 15 through 19 given to the groups G1 through G5. As a result, priority is given to the groups G1 through G5, and a layer 56 of FIG. 4 is generated. A group number, for example, G6 and a layer number 110 are given to this layer.

When, for example, a mirror inversion is given to the grouped layer 56, then the layer 56 is copied, a layer 58 will be generated. For this processing, the programs of the copy unit 32 and the mirror inversion unit 36 are used. Next, the layer 56 is copied and partially modified to generate a layer 60. Lastly, the highest priority is given to the pattern data layer 52, and the layers 54 through 60 are layered in the priority sequence defined according to the order of the layer numbers to obtain the design data 50 shown in the left top of FIG. 4.

Although not illustrated in FIG. 4 or FIG. 5, any layer number including layer number for group can be changed at any time. To do so, it is sufficient to select change of layer number from the menu. In this case, each layer together with the layer number thereof is displayed on the monitor 20, and the user designates which layer has what priority level. For example, a layer is designated to have a priority level that is between those of two other layers. Or a layer is designated to have the lowest priority. According to the priority levels newly designated in the above-mentioned manner, the layer numbers are readjusted and converted into integers to generate new layer numbers.

With grouping, change of layer number for group and cancellation of grouping or de-grouping are also needed. These processes are also selected from the menu. Change of layer number for group is exactly the same process as change of layer number for ordinary layer. When a grouping is cancelled, the group number and the layer number of the group will be deleted. The data of the grouped layers are divided into the data of the respective original individual layers and regenerated in the memory 24. Processes of copy, move, retouch, etc. are made by layer. When a process is designated in the menu and a layer is designated, the process will begin. Move, deletion, retouch, etc. of a layer do not give any effects on other layers. Hence design modification is extremely easy.

Grading is made with reference to the grading rule table 42, and the pattern data are modified according to this table. The lowest priority layer 54 here is, for example, data on just a wide area having a color number C1, and normally does not get any effects of grading. For the respective layers, only the areas overlapping with the pattern data 52 are effective. The positions of the layers 56, 58 and 60 may be modified or may not be modified by grading. Whether the positions are modified or not depends which rule of the grading rule table 42 is referred to. For example, when a rule of moving the layers 56, 58 and 60 is in effect, the respective layers 56, 58 and 60 will be moved due to grading. Modification of the positions of these layers is effected by modifying the offset (X, Y).

In case of integral knit, besides the design data 50 of the front body, there are design data of the back body and both sleeves, and the shapes of the armholes are determined in advance so that both sleeves can be connected to the body. Regarding the design of the back body, it is designed by seeing from the back side of the sweater, and when the design is converted into knitting data, the data will be converted into data seen from the front. This requires the face stitch/back stitch inversion and the mirror inversion of the design data. The program for the mirror inversion is stored in the mirror inversion unit 38, and the inversion of face stitch and back stitch can be done easily by switching the color numbers with the graphic processor 14. For example, when a pocket is provided on the front back, the pocket is given a descriptor that is different from the descriptor of the front body, and the knitting data of the pocket are stored in a layer different from the layer of the front body. In this way, a move of the pocket position does not give any effects on the design data of the front body, and modification of a pattern in the pocket does not give any effects on the binding off of the pocket and the front body.

I claim:

1. A knit design method of designing a knitted fabric, while inputting the design data of the knitted fabric and displaying the inputted design data on a monitor, comprising:

giving, when a design element of the knitted fabric is inputted, a priority level to the design data of the element and storing the data as a data layer;

determining, when plural layers are overlapped on the same position in the design of the knitted fabric, the priority levels of the layers according to said priority level; and converting the design data of the knitted fabric into knitting data according to the determined priority levels.

2. A knit design method of claim 1 being characterized in that a process for modifying said priority sequence according to a request of the user is provided.

3. A knit design method of claim 2 being characterized in that a process for grouping plural layers and giving a new priority level is included.

4. A knit design method of claim 3 being characterized in that a process for disintegrating grouped layers into individual layers is included.

5. A knit design method of claim 1 being characterized in that data of at least some layers are inputted and stored as non-raster data.

6. A knit design method of claim 5 being characterized in that the design data are stored as both raster data and non-raster data, and that input as raster data by the user is accepted, a priority level is given to the data and the input is stored as raster data.

7. A knit design apparatus having an input means for inputting the design data of a knitted fabric and a monitor for displaying the inputted design data, comprising:

a means for giving priority levels to the inputted design data of the respective design elements of the design of the knitted fabric and storing the design data as data layers;

a retrieval means for determining the priority levels of layers according to the priority sequence when plural layers are overlapped on the same position of the design of the knitted fabric; and a compiler for converting the design data of a relevant layer into knitting data according to the determined priority levels.

8. A knit design apparatus of claim 7 being characterized in that a means is provided for accepting an input of priority level by the user and for giving, when the user does not input a priority level, a priority level, being higher at least than that of some of already inputted layers, to the newly inputted layer.

9. A knit design apparatus of claim 8 being characterized in that a means for storing a menu program is provided, and a menu is displayed on at least a part of the monitor, and that said menu is provided with a sub-menu for modifying priority, the user is asked to designate the priority levels of the new layers, and the priority sequence of layers is modified according to the designated priority levels and stored.

10. A knit design apparatus of claim 7 being characterized in that said retrieval means is configured to retrieve the data of the respective layers in the order from the layer of the lowest priority to the layer of the highest priority, and to overwrite the design data of a layer of higher priority on the design data of a layer of lower priority.

11. A knit design apparatus of claim 9 being characterized in that said menu is provided with sub-menus for grouping plural layers and cancelling of grouping, that plural layers designated by the user is formed into a group by grouping and a priority level is given to the group, and that a group is separated into individual layers by cancellation of grouping.

12. A knit design apparatus of claim 7 being characterized in that said memory is provided with a memory for storing design data in non-raster format.

13. A knit design apparatus of claim 12 being characterized in that said memory is composed of a memory for said non-raster format and a memory for storing design data of at least some of the layers in raster format.

* * * * *